US009951647B2

(12) United States Patent
Rawson

(10) Patent No.: US 9,951,647 B2
(45) Date of Patent: Apr. 24, 2018

(54) SYSTEM AND METHOD FOR IN SITU CLEANING OF INTERNAL COMPONENTS OF A GAS TURBINE ENGINE AND A RELATED PLUG ASSEMBLY

(71) Applicant: General Electric Company, Schenectady, NY (US)

(72) Inventor: Lloyd Eric Rawson, Mason, OH (US)

(73) Assignee: General Electric Company, Schenectady, NY (US)

( * ) Notice: Subject to any disclaimer, the term of this patent is extended or adjusted under 35 U.S.C. 154(b) by 304 days.

(21) Appl. No.: 14/972,169

(22) Filed: Dec. 17, 2015

(65) Prior Publication Data

US 2017/0175569 A1 Jun. 22, 2017

(51) Int. Cl.

| | |
|---|---|
| ***F01D 25/00*** | (2006.01) |
| ***F01D 25/26*** | (2006.01) |
| ***B08B 9/032*** | (2006.01) |

(52) U.S. Cl.

CPC ..... *F01D 25/002* (2013.01); *B08B 9/0321* (2013.01); *F01D 25/26* (2013.01); *F05D 2220/32* (2013.01); *F05D 2230/60* (2013.01); *F05D 2260/60* (2013.01)

(58) Field of Classification Search

CPC ..... F01D 25/002; F01D 25/26; B08B 9/0321; F05D 2220/32; F05D 2230/60; F05D 2260/60

See application file for complete search history.

(56) References Cited

U.S. PATENT DOCUMENTS

| | | | | |
|---|---|---|---|---|
| 3,623,668 A | | 11/1971 | Fried et al. | |
| 3,954,921 A | * | 5/1976 | Yoshida | B01D 47/06 239/549 |
| 5,385,014 A | * | 1/1995 | Rathbun | F01D 25/002 134/22.1 |
| 5,679,174 A | | 10/1997 | Buongiorno | |

(Continued)

FOREIGN PATENT DOCUMENTS

| | | |
|---|---|---|
| FR | 3 001 401 A1 | 8/2014 |
| WO | 01/07178 A1 | 2/2001 |

OTHER PUBLICATIONS

Extended European Search Report and Opinion issued in connection with corresponding EP Application No. 16202497.0 dated Jun. 19, 2017.

*Primary Examiner* — Igor Kershteyn
(74) *Attorney, Agent, or Firm* — General Electric Company; Pamela A. Kachur

(57) ABSTRACT

A system for in situ cleaning of internal components of a gas turbine engine may generally include a plug assembly defining a fluid passageway that is configured to be installed within an access port of the engine such that the fluid passageway defines a flow path between inner and outer casings of the engine. The plug assembly may include an inner sleeve at least partially defining the fluid passageway and an outer sleeve configured to receive a portion of the inner sleeve. The system may also include a fluid conduit configured to be coupled between a fluid source positioned external to the gas turbine engine and an inlet end of the plug assembly for supplying a cleaning fluid to the plug assembly. The cleaning fluid may be directed through the fluid passageway and may then be expelled from the plug assembly into the interior of the gas turbine engine.

20 Claims, 7 Drawing Sheets

(56) References Cited

U.S. PATENT DOCUMENTS

| | | | | |
|---|---|---|---|---|
| 5,938,402 | A | 8/1999 | Bochud et al. | |
| 5,944,483 | A * | 8/1999 | Beck | F01D 25/002 134/104.1 |
| 6,233,937 | B1 | 5/2001 | Gray | |
| 6,805,140 | B2 | 10/2004 | Velez, Jr. et al. | |
| 6,883,527 | B2 | 4/2005 | Travaly et al. | |
| 6,932,093 | B2 | 8/2005 | Ogden et al. | |
| 7,065,955 | B2 | 6/2006 | Reback et al. | |
| 7,198,052 | B2 | 4/2007 | Watt | |
| 7,373,781 | B2 | 5/2008 | Reback et al. | |
| 7,454,913 | B1 | 11/2008 | Tassone et al. | |
| 7,531,048 | B2 | 5/2009 | Woodcock et al. | |
| 7,540,157 | B2 * | 6/2009 | Fish | F02C 7/222 29/469 |
| 8,066,816 | B2 * | 11/2011 | Asplund | B08B 9/0323 134/22.1 |
| 8,245,952 | B2 | 8/2012 | de la Bruere-Terreault et al. | |
| 8,303,243 | B2 | 11/2012 | Fish et al. | |
| 8,337,630 | B2 | 12/2012 | de la Bruere-Terreault et al. | |
| 8,632,639 | B2 | 1/2014 | Bottcher et al. | |
| 2008/0078422 | A1 | 4/2008 | Wagner | |
| 2010/0132745 | A1 | 6/2010 | Hjerpe et al. | |
| 2010/0178158 | A1 * | 7/2010 | Fish | F01D 25/002 415/116 |
| 2013/0174869 | A1 | 7/2013 | Rosing et al. | |
| 2013/0199040 | A1 | 8/2013 | Dudeck et al. | |
| 2014/0209124 | A1 | 7/2014 | Lockyer | |

* cited by examiner

SYSTEM AND METHOD FOR IN SITU CLEANING OF INTERNAL COMPONENTS OF A GAS TURBINE ENGINE AND A RELATED PLUG ASSEMBLY

FIELD OF THE INVENTION

The present subject matter relates generally to gas turbine engines and, more particularly, to a system and method for in situ cleaning of internal components of a gas turbine engine and a related plug assembly to be used for performing in situ cleaning operations.

BACKGROUND OF THE INVENTION

A gas turbine engine typically includes a turbomachinery core having a high pressure compressor, combustor, and high pressure turbine in serial flow relationship. The core is operable in a known manner to generate a primary gas flow. The high pressure compressor includes annular arrays ("rows") of stationary vanes that direct air entering the engine into downstream, rotating blades of the compressor. Collectively one row of compressor vanes and one row of compressor blades make up a "stage" of the compressor. Similarly, the high pressure turbine includes annular rows of stationary nozzle vanes that direct the gases exiting the combustor into downstream, rotating blades of the turbine. Collectively one row of nozzle vanes and one row of turbine blades make up a "stage" of the turbine. Typically, both the compressor and turbine include a plurality of successive stages.

With operation of a gas turbine engine, dust, debris and other materials can build-up onto the internal components of the engine over time, which can result in a reduction in the operating efficiency of such components. For example, dust layers and other materials often become baked onto the airfoils of the high pressure compressor. To remove such material deposits, current cleaning methods utilize a guided hose to inject water into the compressor inlet. Unfortunately, such conventional cleaning methods often provide insufficient cleansing of the compressor airfoils, particularly the airfoils located within the aft stages of the compressor.

Accordingly, an improved system and method for in situ cleaning of internal components of a gas turbine engine would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a system for in situ cleaning of internal components of a gas turbine engine. The system may generally include a plug assembly defining a fluid passageway extending lengthwise between an inlet end and an outlet end. The plug assembly may be configured to be installed within an access port of the engine such that the fluid passageway defines a flow path between inner and outer casings of the engine for supplying a cleaning fluid within an interior of the engine. The plug assembly may include an inner sleeve at least partially defining the fluid passageway and an outer sleeve configured to receive a portion of the inner sleeve. The inner sleeve may be configured to be coupled to the inner casing and the outer sleeve may be configured to be coupled to the outer casing. The system may also include a fluid conduit configured to be coupled between a fluid source positioned external to the gas turbine engine and the inlet end of the plug assembly for supplying the cleaning fluid to the plug assembly. The cleaning fluid supplied from the fluid conduit may be directed through the fluid passageway from the inlet end to the outlet end and may then be expelled from the plug assembly into the interior of the gas turbine engine.

In another aspect, the present subject matter is directed to a gas turbine engine. The engine may generally include an outer casing and an inner casing spaced radially inwardly from the outer casing by a radial distance. The outer casing may define an outer portion of an access port of the engine and the inner casing may define an inner portion of the access port. The engine may also include a plug assembly defining a fluid passageway extending lengthwise between an inlet end and an outlet end. The plug assembly may be installed within the inner and outer portions of the access port such that the fluid passageway defines a flow path between the inner and outer casings for supplying a cleaning fluid within an interior of the engine. The plug assembly may include an inner sleeve at least partially defining the fluid passageway and an outer sleeve configured to receive a portion of the inner sleeve. The inner sleeve may be coupled to the inner casing and the outer sleeve may be coupled to the outer casing. In addition, the engine may include a cap configured to be removably coupled to the outer sleeve at the outlet end of the plug assembly. The cap may be configured to prevent fluid flow through the fluid passageway when the cap is installed onto the plug assembly.

In a further aspect, the present subject matter is directed to a method for in situ cleaning of internal components of a gas turbine engine. The method may generally include accessing a plug assembly installed within an access port defined through inner and outer casings of the gas turbine engine. The plug assembly may define a fluid passageway extending lengthwise between an inlet end and an outlet end such that the fluid passageway defines a flow path between the inner and outer casings. The plug assembly may include an inner sleeve at least partially defining the fluid passageway and an outer sleeve configured to receive a portion of the inner sleeve. The method may also include coupling a fluid conduit between a fluid source positioned external to the gas turbine engine and an inlet end of the plug assembly and supplying a cleaning fluid from the fluid source through the fluid conduit to the plug assembly such that the cleaning fluid is directed through the fluid passageway defined by the plug assembly and is expelled from an outlet end of the plug assembly into an interior of the gas turbine engine.

These and other features, aspects and advantages of the present invention will be better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
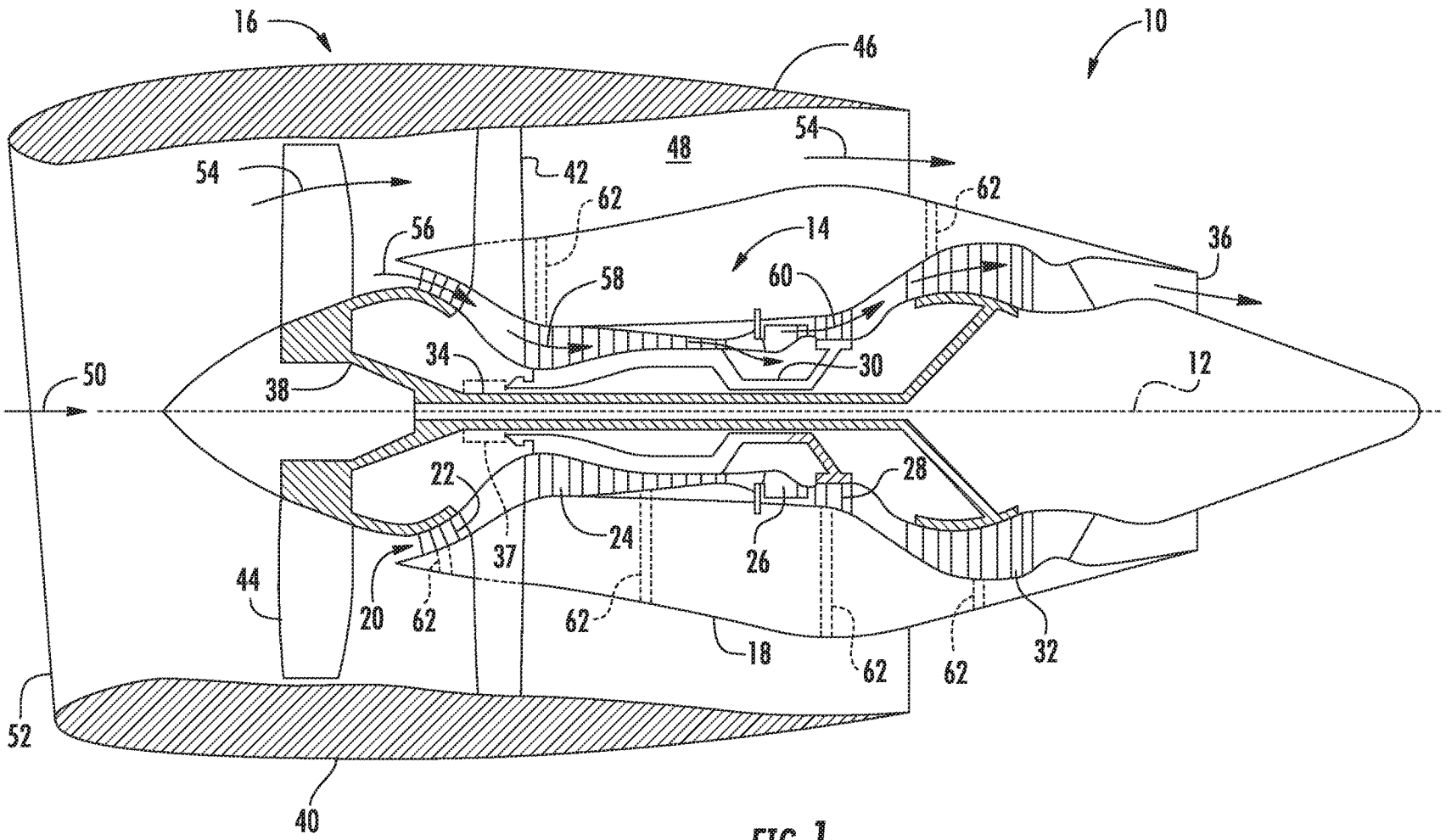
FIG. 1 illustrates a cross-sectional view of one embodiment of a gas turbine engine that may be utilized within an aircraft in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system and method for in situ cleaning of internal components of a gas turbine engine. Specifically, in several embodiments, the present disclosure is directed to a plug assembly that is configured to be installed within an access port of the gas turbine engine to allow a cleaning fluid to be injected into the interior of the engine to provide targeting cleaning of one or more internal components of the engine. For example, as will be described below, the plug assembly may define a fluid passageway that extends between an inlet end and an outlet end, with the inlet end being accessible to the exterior of the engine and the outlet end being in fluid communication with the interior of the engine. In such embodiments, by coupling a fluid hose or conduit to the inlet end of the plug assembly, a cleaning fluid may be supplied to the plug assembly from a location exterior to the engine and subsequently injected into the interior of the engine. Moreover, the plug assembly may also be configured to be capped or plugged when the assembly is not being used to provide access to the interior of the engine. As such, the plug assembly may remain installed within the access port during operation of the engine.

In a particular embodiment of the present subject matter, one or more of the disclosed plug assemblies may be installed within one or more of the access ports providing internal access to the high pressure compressor of a gas turbine engine to allow for targeted cleaning of the internal components of the compressor, such as the compressor blades and/or vanes. For example, the plug assembly(ies) may be installed within the access port(s) providing access to one or more of the aft stages of the compressor to allow baked-on dust layers and other material deposits to be removed from the airfoils located within such stage(s).

It should be appreciated that, for purposes of description, the disclosed system and method will be described herein with reference to providing targeted, in situ cleaning of internal components of the high pressure compressor of a gas turbine engine. However, in general, the system and method disclosed herein may be used to provide targeted, in situ cleaning within the interior of any other suitable component of a gas turbine engine. Additionally, it should be appreciated that the disclosed system and method may generally be used to provide in situ cleaning of internal components located within any suitable type of gas turbine engine, including aircraft-based turbine engines and land-based turbine engines, regardless of the engine's current assembly state (e.g., fully or partially assembled). Moreover, with reference to aircraft engines, it should be appreciated that the present subject matter may be implemented on wing or off wing.

Referring now to the drawings, FIG. 1 illustrates a cross-sectional view of one embodiment of a gas turbine engine 10 that may be utilized within an aircraft in accordance with aspects of the present subject matter, with the engine 10 being shown having a longitudinal or axial centerline axis 12 extending therethrough for reference purposes. In general, the engine 10 may include a core gas turbine engine (indicated generally by reference character 14) and a fan section 16 positioned upstream thereof. The core engine 14 may generally include a substantially tubular outer casing 18 that defines an annular inlet 20. In addition, the outer casing 18 may further enclose and support a booster compressor 22 for increasing the pressure of the air that enters the core engine 14 to a first pressure level. A high pressure, multi-stage, axial-flow compressor 24 may then receive the pressurized air from the booster compressor 22 and further increase the pressure of such air. The pressurized air exiting the high-pressure compressor 24 may then flow to a combustor 26 within which fuel is injected into the flow of pressurized air, with the resulting mixture being combusted within the combustor 26. The high energy combustion products are directed from the combustor 26 along the hot gas path of the engine 10 to a first (high pressure) turbine 28 for driving the high pressure compressor 24 via a first (high pressure) drive shaft 30, and then to a second (low pressure) turbine 32 for driving the booster compressor 22 and fan section 16 via a second (low pressure) drive shaft 34 that is generally coaxial with first drive shaft 30. After driving each of turbines 28 and 32, the combustion products may be expelled from the core engine 14 via an exhaust nozzle 36 to provide propulsive jet thrust.

Additionally, as shown in FIG. 1, the fan section 16 of the engine 10 may generally include a rotatable, axial-flow fan rotor assembly 38 that is configured to be surrounded by an annular fan casing 40. It should be appreciated by those of ordinary skill in the art that the fan casing 40 may be configured to be supported relative to the core engine 14 by a plurality of substantially radially-extending, circumferentially-spaced outlet guide vanes 42. As such, the fan casing 40 may enclose the fan rotor assembly 38 and its corresponding fan rotor blades 44. Moreover, a downstream section 46 of the fan casing 40 may extend over an outer portion of the core engine 14 so as to define a secondary, or by-pass, airflow conduit 48 that provides additional propulsive jet thrust.

It should be appreciated that, in several embodiments, the second (low pressure) drive shaft 34 may be directly coupled to the fan rotor assembly 38 to provide a direct-drive configuration. Alternatively, the second drive shaft 34 may be coupled to the fan rotor assembly 38 via a speed reduction device 37 (e.g., a reduction gear or gearbox) to provide an indirect-drive or geared drive configuration. Such a speed reduction device(s) may also be provided between any other suitable shafts and/or spools within the engine 10 as desired or required.

During operation of the engine 10, it should be appreciated that an initial air flow (indicated by arrow 50) may enter the engine 10 through an associated inlet 52 of the fan casing 40. The air flow 50 then passes through the fan blades 44 and splits into a first compressed air flow (indicated by arrow 54) that moves through conduit 48 and a second compressed air flow (indicated by arrow 56) which enters the booster compressor 22. The pressure of the second compressed air flow 56 is then increased and enters the high pressure compressor 24 (as indicated by arrow 58). After mixing with fuel and being combusted within the combustor 26, the combustion products 60 exit the combustor 26 and flow through the first turbine 28. Thereafter, the combustion products 60 flow through the second turbine 32 and exit the exhaust nozzle 36 to provide thrust for the engine 10.

The gas turbine engine 10 may also include a plurality of access ports defined through its casings and/or frames for providing access to the interior of the core engine 14. For instance, as shown in FIG. 1, the engine 10 may include a plurality of access ports 62 (only six of which are shown) defined through the outer casing 18 for providing internal access to one or both of the compressors 22, 24 and/or for providing internal access to one or both of the turbines 28, 32. In several embodiments, the access ports 62 may be spaced apart axially along the core engine 14. For instance, the access ports 62 may be spaced apart axially along each compressor 22, 24 and/or each turbine 28, 32 such that at least one access port 62 is located at each compressor stage and/or each turbine stage for providing access to the internal components located at such stage(s). In addition, the access ports 62 may also be spaced apart circumferentially around the core engine 14. For instance, a plurality of access ports 62 may be spaced apart circumferentially around each compressor stage and/or turbine stage.

Figure 2:
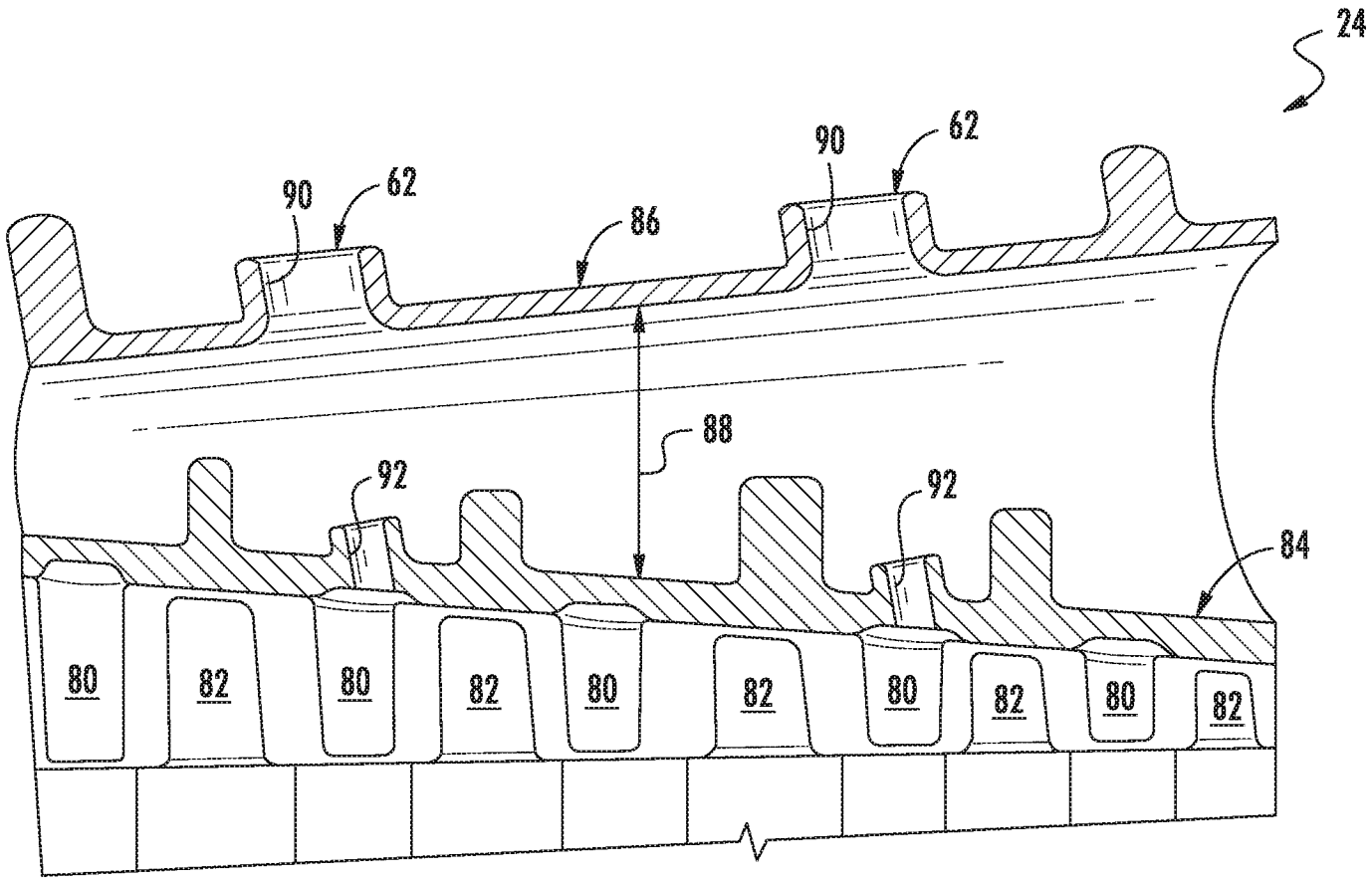
FIG. 2 illustrates a simplified, cross-sectional view of one embodiment of a portion of a compressor suitable for use within the gas turbine engine shown in FIG. 1, particularly illustrating access ports defined through the compressor casings for providing internal access to the compressor.

Referring now to FIG. 2, a simplified, cross-sectional view of a portion of the high pressure compressor 24 described above with reference to FIG. 1 is illustrated in accordance with aspects of the present subject matter. As shown, the compressor 24 may include a plurality of compressor stages, with each stage including both an annular array of fixed compressor vanes 80 (only one of which is shown for each stage) and an annular array of rotatable compressor blades 82 (only one of which is shown for each stage). Each row of compressor vanes 80 is generally configured to direct air flowing through the compressor 24 to the row of compressor blades 82 immediately downstream thereof.

Additionally, the compressor 24 may include an inner casing 84 configured to encase the various compressor stages and an outer casing 86 spaced radially outwardly from the inner casing 84. For example, as shown in FIG. 2, the outer casing 86 may be spaced apart from the inner casing 84 by a radial distance 88. The radial distance 88 defined between the inner and outer casings 84, 86 may vary, by design, along the axial length of the compressor 24. In addition, due to the differing rates of thermal expansion between the inner and outer casings 84, 86, the radial distance 88 at a given axial location along the compressor 24 may vary during operation of the gas turbine engine 10. For instance, the inner casing 84 may expand at a faster rate than the outer casing 86, thereby causing a reduction in the radial distance 88 defined between the inner and outer casings 84, 86.

Moreover, the compressor 24 may include a plurality of access ports 62 defined through the inner and outer casings 84, 86, with each access port 62 being configured to provide access to the interior of the compressor 24 at a different axial location. For example, as shown in FIG. 2, each access port 62 may include an outer portion 90 defined through the outer casing 86 and an inner portion 92 defined through the inner casing 84. As such, by inserting an optical probe, repair tool and/or other device through the inner and outer portions 92, 90 of a given access port 62, a service worker may gain access to the interior of the compressor 24.

In several embodiments, the access ports 62 may be spaced apart axially such that each access port 62 is aligned with or otherwise provides interior access to a different stage of the compressor 24. For instance, as shown in FIG. 2, two separate access ports 62 are illustrated that provide access to two different stages of the compressor 24. In other embodiments, it should be appreciated that similar access ports 62 may also be provided for any of the other stages of the compressor 24. It should also be appreciated that, in addition to axially spaced access ports 62, access ports 62 may be also provided at differing circumferentially spaced locations. For instance, in one embodiment, a plurality of circumferentially spaced access ports 62 may be defined through the compressor casings 84, 86 at each compressor stage to provide interior access to the compressor 24 at multiple circumferential locations around the compressor stage.

Figure 3:
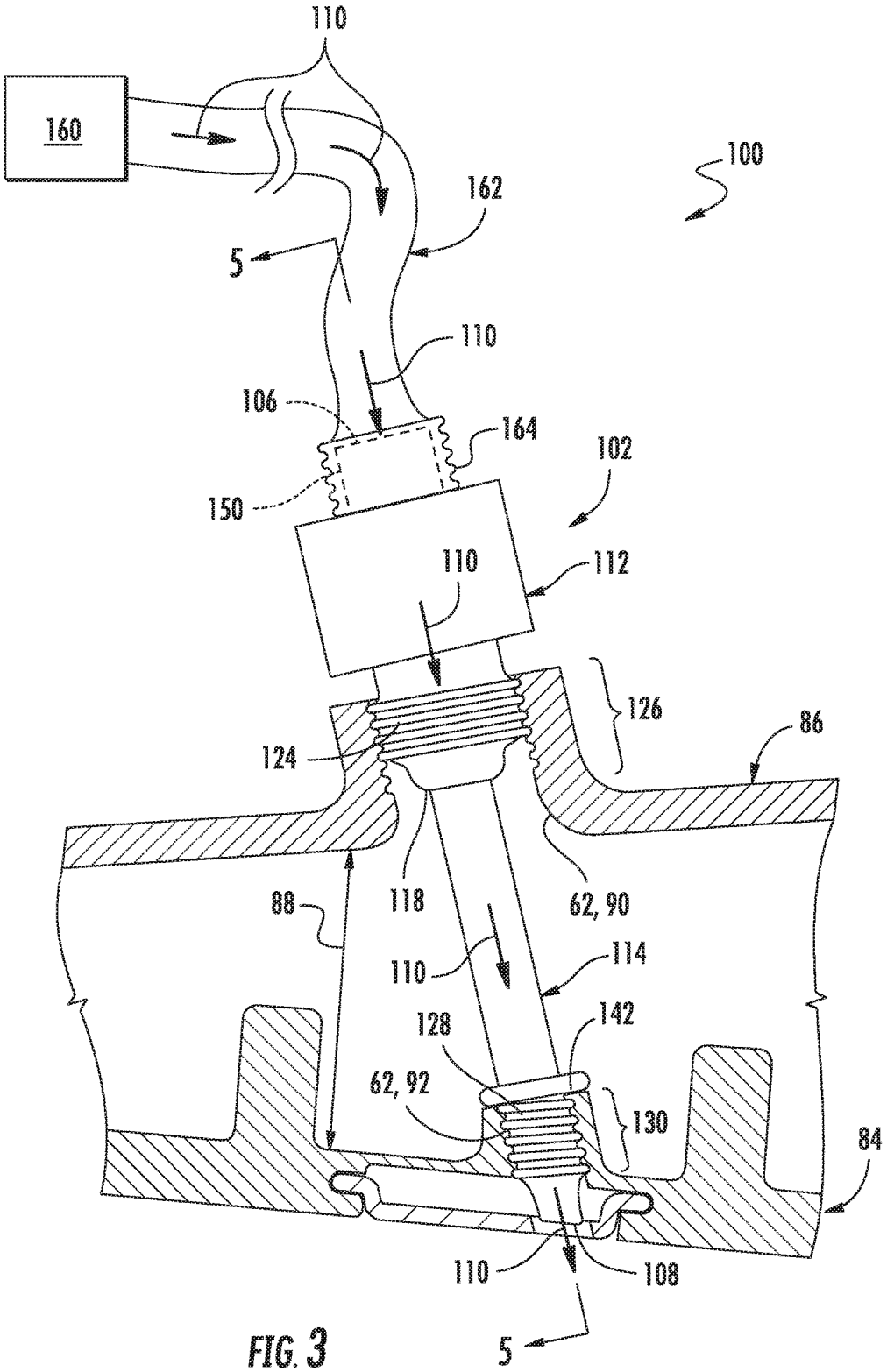
FIG. 3 illustrates one embodiment of a system for in situ cleaning of internal components of a gas turbine engine in accordance with aspects of the present subject matter, particularly illustrating a portion of the cross-sectional view of the compressor shown in FIG. 2 with a plug assembly of the disclosed system being installed within one of the compressor access ports and being in an unplugged/uncapped state to allow a cleaning fluid to be injected through the plug assembly and into the interior of the compressor.
Figure 4:
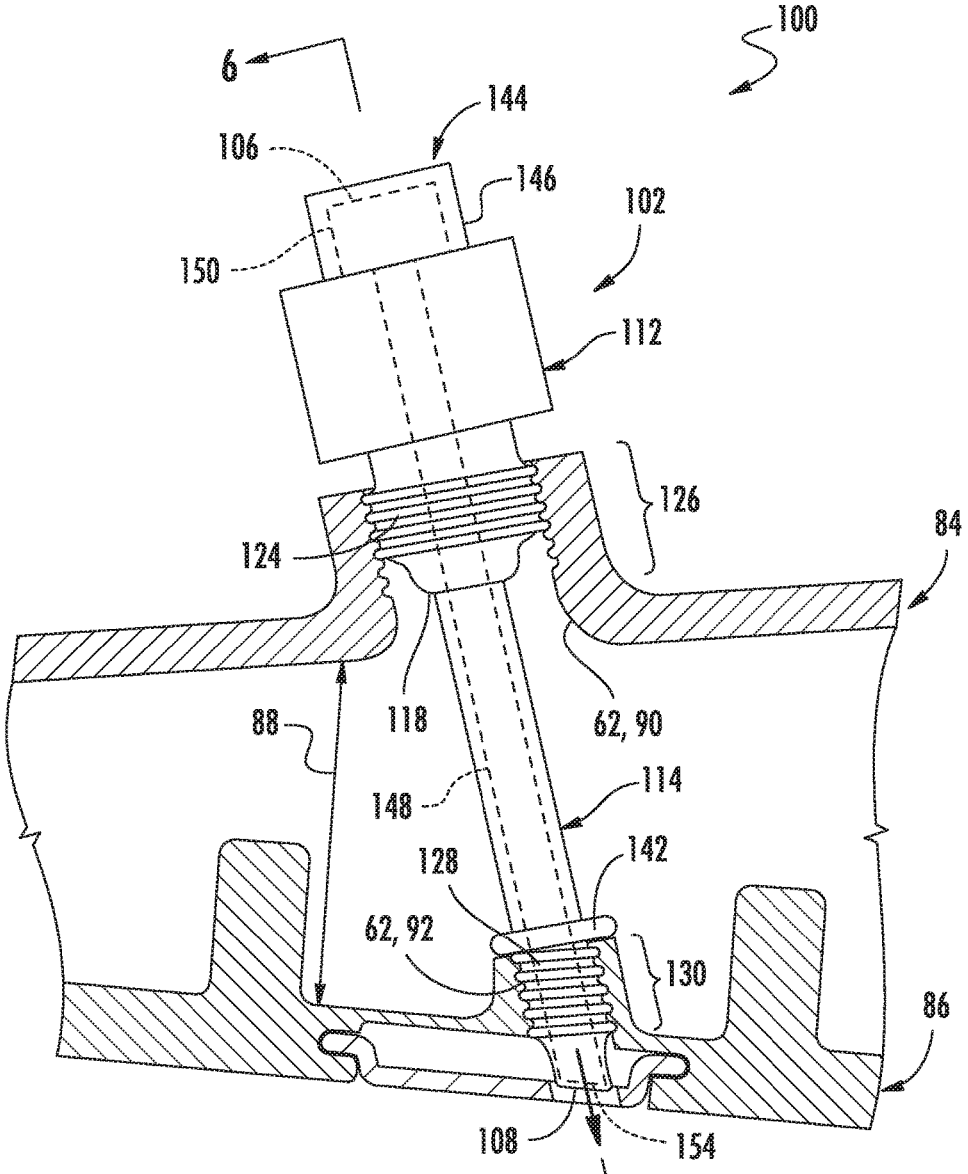
FIG. 4 illustrates a similar cross-sectional view as that shown in FIG. 3, particularly illustrating the plug assembly in a plugged/capped state to prevent fluid flow through the assembly during operation of the gas turbine engine.
Figure 5:
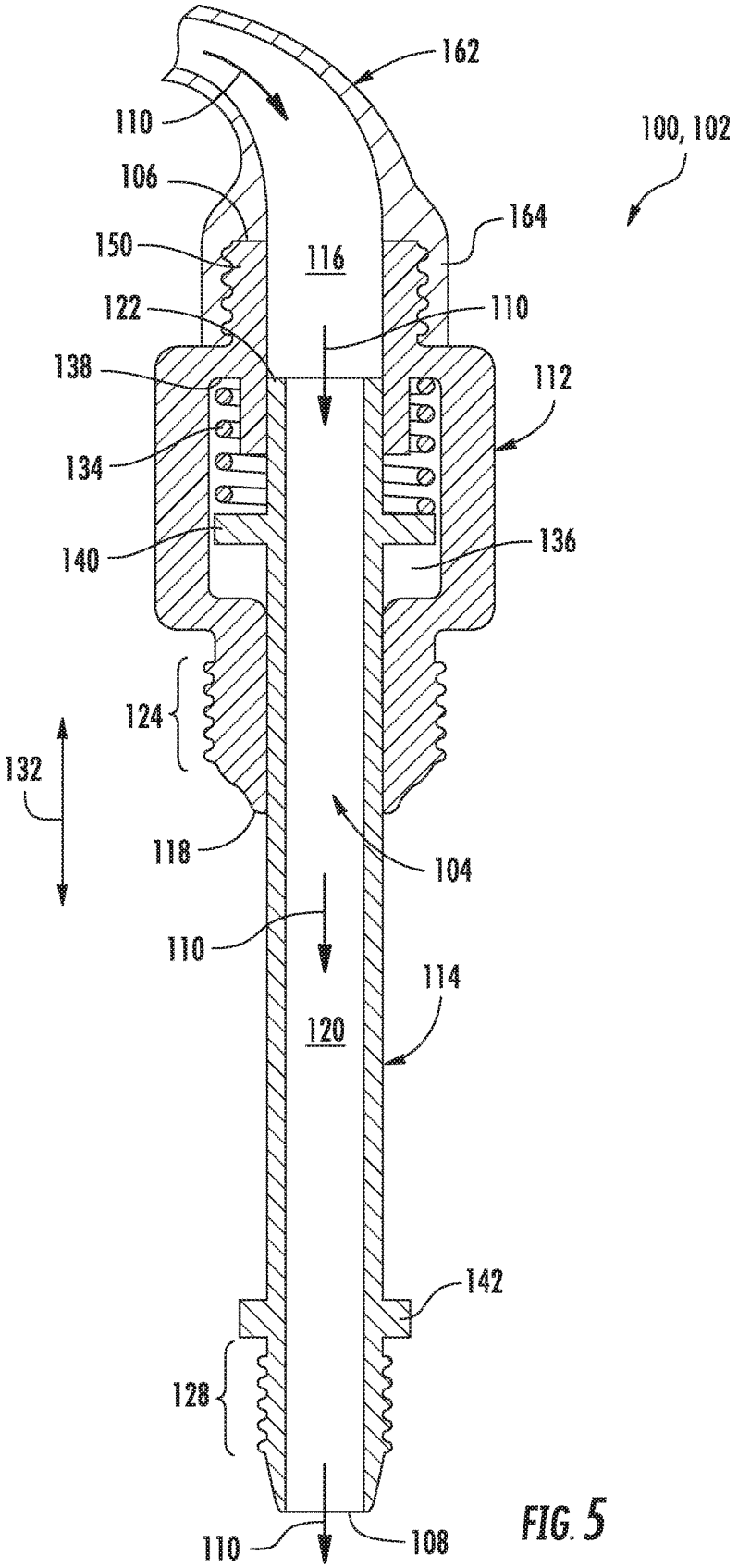
FIG. 5 illustrates a cross-sectional view of the plug assembly shown in FIG. 3 taken about line 5-5, particularly illustrating the plug assembly in its unplugged/uncapped state to allow a cleaning fluid to be injected through the plug assembly and into the interior of the compressor.
Figure 6:
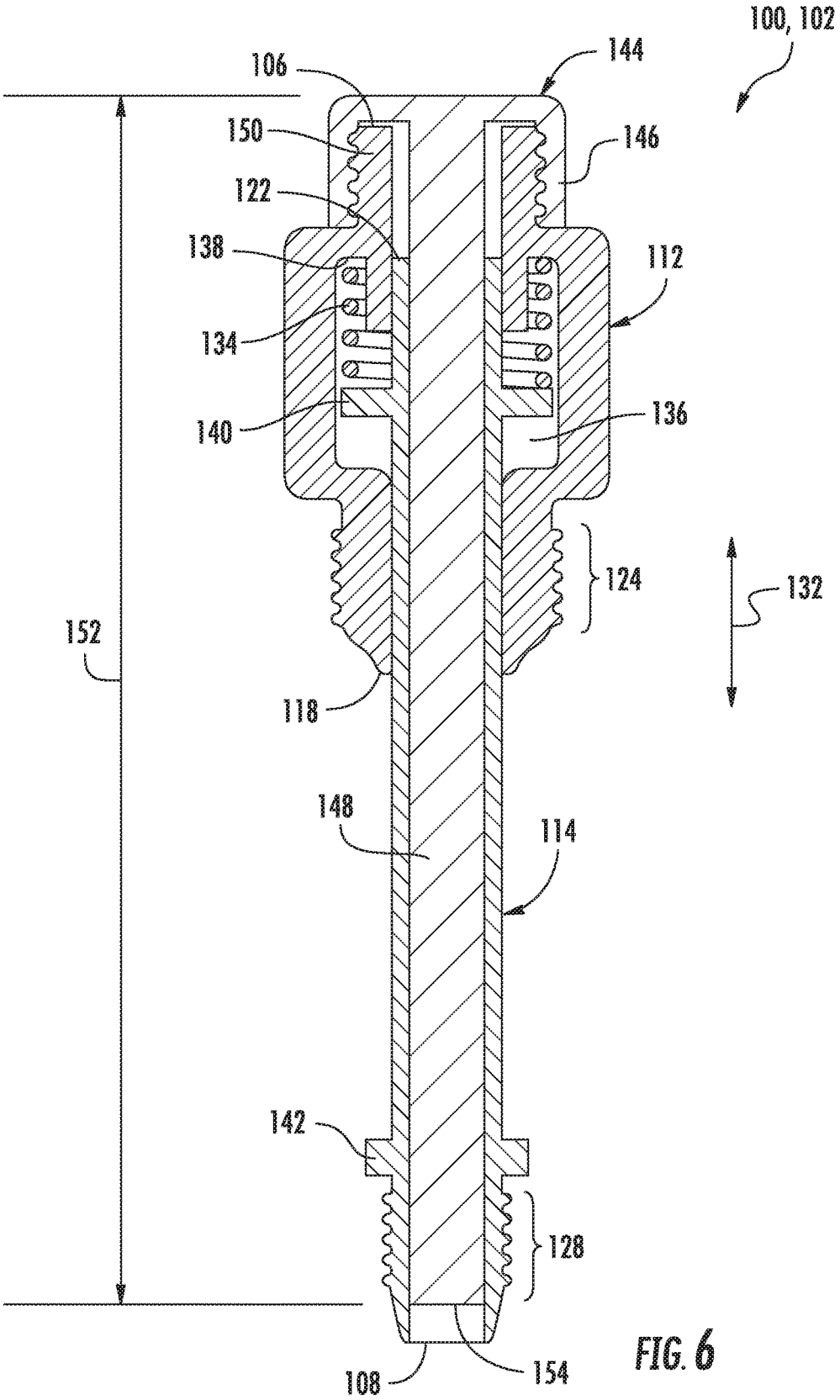
FIG. 6 illustrates a cross-sectional view of the plug assembly shown in FIG. 4 taken about line 6-6, particularly illustrating the plug assembly in its plugged/capped state to prevent fluid flow through the assembly during operation of the gas turbine engine.

Referring now to FIGS. 3-6, one embodiment of a system 100 for in situ cleaning of internal components of a gas turbine engine 10 is illustrated in accordance with aspects of the present subject matter. Specifically, FIGS. 3 and 4 illustrate a portion of the cross-sectional view of the high pressure compressor 24 shown in FIG. 2 with a plug assembly 102 of the disclosed system 100 being installed within one of the compressor access ports 62. In this regard, FIG. 3 illustrates the plug assembly 102 in an unplugged/uncapped state to allow a cleaning fluid to be injected through the plug assembly 102 and into the interior of the compressor 24 while FIG. 4 illustrates the plug assembly 102 in a plugged/capped state to prevent fluid flow through the assembly 102 during operation of the gas turbine engine 10. Additionally, FIGS. 5 and 6 illustrate cross-sectional views of the plug assembly 102 shown in FIGS. 3 and 4 respectively, with FIG. 5 illustrating the plug assembly 102 in its unplugged/uncapped state and FIG. 6 illustrating the plug assembly 102 in its plugged/capped state.

In general, the system 100 will be described herein with reference to providing targeted, in situ cleaning of the internal components of the high pressure compressor 24 of the gas turbine engine 10 described above with reference to FIGS. 1 and 2, such as the vanes 80 and/or blades 82 of the compressor 24. However, it should be appreciated that, in other embodiments, the system 100 may be similarly used to provide in situ cleaning of any other suitable internal engine components. For instance, as opposed to installing the disclosed system components relative to an access port 62 defined through the casing(s) 84, 86 of the compressor 24, the system components may be installed relative to an access port defined through the casing(s) of one of the turbines 28, 32 to allow an in situ cleaning operation to be performed on the internal engine component(s) of the turbine(s) 28, 32, such as the turbine blades and/or nozzles.

As shown in FIGS. 3-6, the system 100 may generally include a plug assembly 102 configured to be installed within the inner and outer portions 92, 90 of a given access port 62 of the compressor 24. In several embodiments, the plug assembly 102 may define a fluid passageway 104 extending lengthwise between an inlet end 106 and an outlet end 108, with the inlet end 106 being positioned at or adjacent to the outer casing 86 of the compressor 24 and the outlet end 108 being positioned at or adjacent to the inner casing 84 of the compressor 24. As such, by installing the plug assembly 102 through the access port 62, the fluid passageway 104 may provide a means for directing a cleaning fluid (indicated by arrows 110 in FIGS. 3 and 5) through the inner and outer casings 84, 86 for subsequent delivery within the interior of the compressor 24.

As shown FIGS. 3-6, in several embodiments, the plug assembly 102 may include an outer sleeve 112 configured to be coupled to the outer casing 86 of the compressor 24 and an inner sleeve 114 configured to be coupled to the inner casing 84 of the compressor 24. Each sleeve 112, 114 may generally define a through-hole or passageway extending along its length. For example, as particularly shown in FIG. 5, the outer sleeve 112 may define an outer passageway 116 extending lengthwise between its outer end (e.g., the inlet end 106 of the plug assembly 102) and its opposed inner end 118. Similarly, the inner sleeve 114 may define an inner passageway 120 extending lengthwise between its outer end 122 and its opposed inner end (e.g., the outlet end 108 of the plug assembly 102). Additionally, as shown in FIGS. 5 and 6, a portion of the inner sleeve 114 may be configured to be received within the outer sleeve 112 so that the outer passageway 116 defined by the outer sleeve 112 is in fluid communication with the inner passageway 120 defined by the inner sleeve 114. As a result, the inner and outer sleeves 114, 112 may collectively define the fluid passageway 104 extending between the inlet and outlet ends 106, 108 of the plug assembly 102.

Additionally, as shown in FIGS. 3 and 4, in several embodiments, the inner and outer sleeves 114, 112 may be configured to be coupled to the inner and outer casings 84, 86, respectively, via a threaded connection. For example, the outer sleeve 112 may define an outer threaded area 124 around its outer perimeter that is configured to engage a corresponding threaded area 126 defined within the outer portion 90 of the access port 62. Similarly, the inner sleeve 114 may define an inner threaded area 128 around its outer perimeter that is configured to engage a corresponding threaded area 130 defined within the inner portion 92 of the access port 62. As such, when installing the plug assembly 102 within the access port 62, the inner and outer threaded areas 128, 124 of the sleeves 114, 112 may be screwed into or otherwise engaged with the corresponding threaded areas 130, 126 of the inner and outer portions 90, 92 of the access port 62 to allow the assembly 102 to be coupled to the inner and outer casings 84, 86.

Moreover, in several embodiments, the inner sleeve 114 may be configured to move relative to the outer sleeve 112 to accommodate relative movement between the inner and outer casings 84, 86. For example, due to the temperature differential between the inner and casings 84, 86 during operation of the gas turbine engine 10, the casings 84, 86 may have differing rates of thermal expansion. Such varied thermal expansion can lead to variations in the radial distance 88 defined between the inner and outer casings 84, 86 at the location of the plug assembly 102. Thus, by allowing the inner sleeve 114 to move relative to the outer sleeve 112, the overall radial height of the plug assembly 102 may be automatically adjusted with variations in the radial distance 88 defined between the inner and outer casings 84, 86 while still maintaining a rigid coupling between the sleeves 114, 112 and the casings 84, 86.

As shown in FIGS. 5 and 6, in one embodiment, the inner sleeve 114 may be configured to slide relative to the outer sleeve 112 in a lengthwise direction of the plug assembly 102 (indicated by arrow 132 in FIGS. 5 and 6) such that the amount of the inner sleeve 114 that is received within the outer passageway 116 of the outer sleeve 112 increases or decreases as the radial distance 88 between the inner and outer casings 84, 86 decreases or increases, respectively. In such an embodiment, the plug assembly 102 may include a biasing mechanism, such as a spring 134, coupled between the inner and outer sleeves 114, 112 to provide a biasing force against the inner sleeve 112 that biases in the inner sleeve 112 in the direction of the inner casing 84. As such, when the radial distance 88 between the inner and outer casings 84, 86 decreases, the compressive force applied through the plug assembly 102 may overcome the biasing force applied by the spring 134, thereby compressing the spring 134 and allowing the inner sleeve 114 to move relative to the outer sleeve 112 in the direction of the inlet end 106 of the plug assembly 102. Similarly, when the radial distance 88 between the inner and outer casings 84, 86 increases, the biasing force applied by the spring 134 may bias the inner sleeve 114 in the direction of the outlet end 108 of the plug assembly 102, thereby allowing the plug assembly 102 to span the increased radial gap between the casings 84, 86.

As shown in the illustrated embodiment, the spring 134 may be positioned within an enlarged portion 136 of the outer passageway 116 defined by the outer sleeve 112 such that the spring 134 extends around at least a portion of the section of the inner sleeve 114 received within the outer sleeve 112. Specifically, as shown in FIGS. 5 and 6, the spring 134 may be engaged between an inner surface 138 of the enlarged portion 136 of the outer passageway 116 and a spring flange 140 extending outwardly from the inner sleeve 114. As such, the biasing force provided by the spring 134 may be applied against the flange 140 to push the inner sleeve 114 away from the inlet end 106 of the plug assembly 102 when the radial distance 88 between the inner and outer casings 84, 86 is increased.

Moreover, in several embodiments, the inner sleeve 114 may define a mounting flange 142 at or adjacent to its inner threaded area 128 that serves as a mechanical stop when installing the inner sleeve 114 relative to the inner casing 84. For example, as shown in FIGS. 3-6, the mounting flange 142 may be positioned radially outwardly from the inner threaded area 128 such that the flange 142 contacts the inner casing 84 when the inner sleeve 114 has been properly installed relative to the casing 84. In addition, such contact between the mounting flange 142 and the inner casing 84 may be used to provide an additional sealed interface between the plug assembly 102 and the inner casing 84, thereby preventing the working fluid flowing through the compressor 24 from leaking through the inner portion 92 of the access port 62.

Referring particularly to FIGS. 4 and 6, the plug assembly 102 may also include a removable cap 144 configured to close-off or otherwise cap the fluid passageway 104 defined by the plug assembly 102 during operation of the gas turbine engine 10. As particularly shown in FIG. 6, the cap 144 may generally include a cap portion 146 and a plug portion 148 extending outwardly from the cap portion 146. The cap portion 146 may generally be configured to be removably coupled to the outer sleeve 112 at the inlet end 106 of the plug assembly 102. For example, as shown in FIG. 6, an end portion 150 of the outer sleeve 112 may be threaded at or adjacent to the inlet end 106 of the assembly 102. In such an embodiment, the inner surface of the cap portion 146 may be similarly threaded to allow the cap portion 146 to be screwed onto the end portion 150 of the outer sleeve 112, thereby providing a means to close-off or cover the inlet end 106 of the plug assembly 102.

Additionally, as shown in FIG. 6, the plug portion 148 of the cap 144 may be configured to be inserted within the fluid passageway 104 of the plug assembly 102 such that, when the cap portion 146 is coupled to the outer sleeve 112, the plug portion 148 extends lengthwise within the plug assembly 102 and occupies a portion of the fluid passageway 106. For example, as shown in the illustrated embodiment, the plug portion 148 generally defines a length 152 between the cap portion 146 and a plug end 154 of the cap 144. In such an embodiment, the length 152 of the plug portion 148 may be selected such that the plug portion 148 occupies all or significant portion of the fluid passageway 106 when the plug portion 148 is inserted within the assembly 102. For instance, as shown in FIG. 6, the length 152 of the plug portion 148 may generally correspond to the overall length of the plug assembly 102 such that the plug end 154 of the cap 144 is generally aligned with and/or positioned at or adjacent to the outlet end 108 of the plug assembly 102.

Referring particularly to FIGS. 3 and 5, the disclosed system 100 may also include a cleaning fluid source 160 (e.g., a mobile cleaning station, a fluid tank and/or any other suitable fluid source) and a fluid conduit 162 configured to be coupled between the fluid source 160 and the plug assembly 102. Specifically, when it is desired to perform an in situ cleaning operation within the compressor 24, the cap 144 may be removed from the plug assembly 102 and the fluid conduit 162 may be coupled to the plug assembly 102 to provide a flow path between the fluid source 160 and the plug assembly 102. Cleaning fluid directed through the fluid conduit 162 from the fluid source 160 may then be supplied to the plug assembly 102 and may flow through the fluid passageway 104 to the outlet end 108 of the assembly 102. The cleaning fluid may then be expelled from the plug assembly 102 into the interior of the compressor 24.

It should be appreciated that the fluid conduit 162 may be configured to be coupled to the plug assembly 102 using any suitable coupling and/or connection means known in the art. For example, as shown in FIG. 5, in one embodiment, a supply end 164 of the conduit 162 may be threaded to allow the end 164 to be coupled to the threaded end portion 150 of the outer sleeve 112. In such an embodiment, when the cap 144 is removed from the plug assembly 102, the supply end 164 of the conduit 162 may be screwed onto the threaded end portion 150 of the outer sleeve 112 to provide a continuous flow path between the conduit 162 and the fluid passageway 104 defined by the plug assembly 102. Alternatively, the fluid conduit 162 may be configured to be coupled to the plug assembly 102 using any other suitable means. For instance, in another embodiment, the supply end 164 of the conduit 162 may be configured to be inserted into the outer passageway 116 of the outer sleeve 112 at the inlet end 106 of the assembly 102 (e.g., via a quick connect-type coupling) to allow cleaning fluid to be supplied through the plug assembly 102 from the conduit 162.

It should also be appreciated that the cleaning fluid used within the system 100 may generally correspond to any suitable fluid. For instance, the cleaning fluid may correspond to a liquid, gas and/or any combination thereof (e.g., foam). In addition, the cleaning fluid may contain and/or may serve as a delivery means for solid materials, such as solid particulates and/or abrasive materials. For instance, a liquid cleaning fluid containing solid abrasives may be supplied through the plug assembly 102 and injected into the compressor 24 at a relatively high pressure to allow the abrasive materials to be used to wear down or abrade away any baked-on material deposits located on the compressor vanes 80 and/or blades 82. Moreover, the cleaning fluid may be supplied through the plug assembly 102 at any suitable pressure and/or velocity. For example, the plug assembly 102 may be configured to accommodate injection of the cleaning fluid using a pulsing pressure technique and/or at ultrasonic velocities.

Additionally, it should be appreciated that the outlet end 108 of the plug assembly 102 may generally have any suitable shape and/or configuration that allows for cleaning fluid to be injected into the interior of the compressor 24. For example, in one embodiment, the outlet end 108 of the plug assembly 102 may be configured or shaped to form a nozzle (e.g., a convergent nozzle or convergent-divergent nozzle), thereby allowing a high pressure stream or jet of cleaning fluid to be injected into the interior of the compressor 24 from the plug assembly 102. Alternatively, the outlet end 108 of the plug assembly 102 may be configured to form any other suitable opening or outlet for expelling cleaning fluid into the interior of the compressor 24.

It should also be appreciated that, although the system 100 has generally been described herein with reference to a single plug assembly 102 installed within a single access port 62 of the gas turbine engine 10, the system 100 may include multiple plug assemblies 102 installed within various different access ports 62 of the engine 10. For instance, plug assemblies 102 may be installed within access ports 62 spaced apart axially along the engine 10, such as by installing a plug assembly 102 within an access port positioned at each compressor stage and/or turbine stage of the gas turbine engine 10. Similarly, plug assemblies 102 may be installed within access ports 62 spaced apart circumferentially around the engine 10, such as by installing a plurality of plug assemblies 102 within the access ports 62 spaced apart circumferentially around a given compressor stage(s) and turbine stage(s).

Moreover, it should be appreciated that the disclosed plug assembly 102 may also be configured to accommodate any tools, probes and/or devices desired to be inserted into the interior of the gas turbine engine 10 via one of its access ports 62. For example, the fluid passageway 104 defined by the plug assembly 102 may be sized so as to accommodate an optical probe, such as a borescope, a fiberscope or a videoscope, used to perform a visual inspection of the interior of the engine 10.

Figure 7:
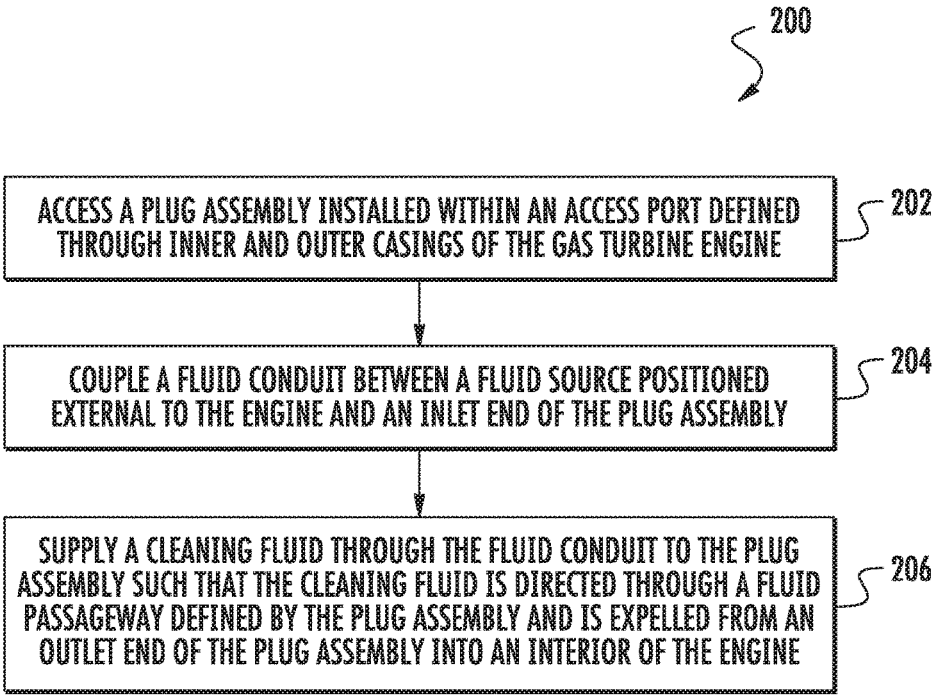
FIG. 7 illustrates a flow diagram of one embodiment of a method for in situ cleaning of internal components of a gas turbine engine in accordance with aspects of the present subject matter.

Referring now to FIG. 7, a flow diagram of one embodiment of a method 200 for in situ cleaning of internal components of a gas turbine engine is illustrated in accordance with aspects of the present subject matter. In general, the method 200 will be discussed herein with reference to the gas turbine engine 10 and the system 100 described above with reference to FIGS. 1-6. However, it should be appreciated by those of ordinary skill in the art that the disclosed method 200 may generally be implemented with gas turbine engines having any other suitable engine configuration and/or with systems having any other suitable system configuration. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 7, at (202), the method 200 includes accessing a plug assembly installed within an access port defined through inner and outer casings of the gas turbine engine. For example, as indicated above, the disclosed plug assembly 102 may be installed within a given access port 62 of the gas turbine engine 10 such that an outer sleeve 112 of the plug assembly 102 is coupled to the outer casing 86 (e.g., within an outer portion 90 of the access port 62 defined by the outer casing 86) and an inner sleeve 114 of the plug assembly 112 is coupled to the inner casing 84 (e.g., within an inner portion 92 of the access port 62 defined by the inner casing 86).

Additionally, at (204), the method 200 may include coupling a fluid conduit between a fluid source positioned external to the gas turbine engine and an inlet end of the plug assembly. For example, as indicated above, a supply end 164 of the fluid conduit 162 may be coupled to the inlet end 106 of the plug assembly 102 and an opposed end of the fluid conduit 162 may be in fluid communication with a suitable fluid source 160. As such, the fluid conduit 162 may provide a flow path between the fluid source 160 and the plug assembly 102.

Moreover, at (206), the method 200 may include supplying a cleaning fluid from the fluid source through the fluid conduit such that the cleaning fluid is directed through a fluid passageway defined by the plug assembly and is expelled from an outlet end of the plug assembly into an interior of the gas turbine engine. Specifically, as indicated above, the plug assembly 102 may define a fluid passageway 104 extending between its inlet and outlet ends 106, 108. Thus, by supplying a cleaning fluid to the inlet end 106 of the plug assembly 102, the cleaning fluid may be directed through the fluid passageway 104 to the outlet end 108 of the plug assembly 102. The cleaning fluid may then be expelled from the plug assembly 102 into the interior of the gas turbine engine 10 to allow one or more internal components of the engine 10 to be cleaned.

It should be appreciated that the disclosed method 200 may further include additional method elements. For example, in one embodiment, the method 200 may include removing a cap 144 from the plug assembly 102 prior to coupling the fluid conduit 162 to the inlet end 106 of the plug assembly 102. In addition, the method 200 may include reinstalling the cap 144 relative to the plug assembly 102 after the cleaning fluid has been supplied through the plug assembly 102 such that a cap portion 146 of the cap 144 is coupled to the outer sleeve 112 and a plug portion 148 of the cap 144 extends lengthwise within the fluid passageway 104 defined by the plug assembly 102.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for in situ cleaning of internal components of a gas turbine engine, the gas turbine engine including an outer casing and an inner casing, the system comprising:

a plug assembly defining a fluid passageway extending lengthwise between an inlet end and an outlet end, the plug assembly configured to be installed within an access port of the gas turbine engine such that the fluid passageway defines a flow path between the inner and outer casings for supplying a cleaning fluid within an interior of the gas turbine engine, the plug assembly including an inner sleeve at least partially defining the fluid passageway and an outer sleeve configured to receive a portion of the inner sleeve, the inner sleeve configured to be coupled to the inner casing and the outer sleeve configured to be coupled to the outer casing; and a fluid conduit configured to be coupled between a fluid source positioned external to the gas turbine engine and the inlet end of the plug assembly for supplying the cleaning fluid to the plug assembly, wherein the cleaning fluid supplied from the fluid conduit is directed through the fluid passageway from the inlet end to the outlet end and is expelled from the plug assembly into the interior of the gas turbine engine.

2. The system of claim 1, wherein the outer sleeve defines an outer threaded area around an outer perimeter of the outer sleeve, the outer threaded area configured to engage a corresponding threaded portion of the access port defined through the outer casing.

3. The system of claim 1, wherein the inner sleeve defines an inner threaded area around an outer perimeter of the inner sleeve, the inner threaded area configured to engage a corresponding threaded portion of the access port defined through the inner casing.

4. The system of claim 1, wherein the inner sleeve is configured to move relative to the outer sleeve with variations in a radial distance defined between the inner and outer casings.

5. The system of claim 4, wherein a biasing member is coupled between the inner and outer sleeves to allow the inner sleeve to move relative to the outer sleeve with variations in the radial distance.

6. The system of claim 1, wherein a threaded end portion of the outer sleeve defines the inlet end of the plug assembly, the fluid conduit being configured to be coupled to the threaded end portion.

7. The system of claim 1, wherein the system further comprises a removable cap configured to be coupled to the outer sleeve at the inlet end of the plug assembly.

8. The system of claim 7, wherein the removable cap includes a cap portion configured to be coupled to the outer sleeve and a plug portion extending outwardly from the cap portion, the plug portion configured to extend lengthwise within the fluid passageway between the inlet and outlet ends of the plug assembly when the cap portion is coupled to the outer sleeve.

9. A gas turbine engine, comprising:

an outer casing, the outer casing defining an outer portion of an access port of the gas turbine engine;

an inner casing spaced radially inwardly from the outer casing by a radial distance, the inner casing defining an inner portion of the access port;

a plug assembly defining a fluid passageway extending lengthwise between an inlet end and an outlet end, the plug assembly being installed within the inner and outer portions of the access port such that the fluid passageway defines a flow path between the inner and outer casings for supplying a cleaning fluid within an interior of the gas turbine engine, the plug assembly including an inner sleeve at least partially defining the fluid passageway and an outer sleeve configured to receive a portion of the inner sleeve, the inner sleeve being coupled to the inner casing and the outer sleeve being coupled to the outer casing; and a cap configured to be removably coupled to the outer sleeve at the outlet end of the plug assembly, the cap being configured to prevent fluid flow through the fluid passageway when the cap is installed onto the plug assembly.

10. The gas turbine engine of claim 9, wherein the outer sleeve defines an outer threaded area around an outer perimeter of the outer sleeve, the outer threaded area configured to engage a corresponding threaded area of the outer portion of the access port defined by the outer casing.

11. The gas turbine engine of claim 9, wherein the inner sleeve defines an inner threaded area around an outer perimeter of the inner sleeve, the inner threaded area configured to engage a corresponding threaded area of the inner portion of the access port defined by the inner casing.

12. The gas turbine of claim 9, wherein the inner sleeve is configured to move relative to the outer sleeve with variations in the radial distance defined between the inner and outer casings.

13. The gas turbine engine of claim 12, wherein a biasing member is coupled between the inner and outer sleeves to allow the inner sleeve to move relative to the outer sleeve with variations in the radial distance.

14. The gas turbine engine of claim 9, wherein the cap includes a cap portion configured to be coupled to the outer sleeve and a plug portion extending outwardly from the cap portion, the plug portion configured to extend lengthwise within the fluid passageway between the inlet and outlet ends of the plug assembly when the cap portion is coupled to the outer sleeve.

15. A method for in situ cleaning of internal components of a gas turbine engine, the gas turbine engine include an inner casing and an outer casing, the method comprising:

accessing a plug assembly installed within an access port defined through the inner and outer casings of the gas turbine engine, the plug assembly defining a fluid passageway extending lengthwise between an inlet end and an outlet end such that the fluid passageway defines a flow path between the inner and outer casings, the plug assembly including an inner sleeve at least partially defining the fluid passageway and an outer sleeve configured to receive a portion of the inner sleeve;

coupling a fluid conduit between a fluid source positioned external to the gas turbine engine and an inlet end of the plug assembly; and supplying a cleaning fluid from the fluid source through the fluid conduit to the plug assembly such that the cleaning fluid is directed through the fluid passageway defined by the plug assembly and is expelled from an outlet end of the plug assembly into an interior of the gas turbine engine.

16. The method of claim 15, further comprising installing the plug assembly within the access port defined through the inner and outer casings of the gas turbine engine.

17. The method of claim 16, wherein installing the plug assembly within the access port comprises:

coupling the outer sleeve of the plug assembly to the outer casing at an outer portion of the access port defined through the outer casing; and coupling the inner sleeve of the plug assembly to the inner casing at an inner portion of the access port defined through the inner casing.

18. The method of claim 15, further comprising removing a cap from the plug assembly prior to coupling the fluid conduit to the inlet end of the plug assembly, the cap including a cap portion configured to be coupled to the outer sleeve and a plug portion extending outwardly from the cap portion.

19. The method of claim 18, further comprising reinstalling the cap relative to the plug assembly after the cleaning fluid has been supplied through the plug assembly such that the cap portion is coupled to the outer sleeve and the plug portion extends lengthwise within the fluid passageway defined by the plug assembly.

20. The method of claim 15, wherein the inner sleeve is configured to move relative to the outer sleeve with variations in a radial distance defined between the inner and outer casings.

* * * * *